US008448285B2

(12) United States Patent
Kayser

(10) Patent No.: US 8,448,285 B2
(45) Date of Patent: May 28, 2013

(54) TOOTHBRUSH AND METHODS OF MAKING AND USING SAME

(75) Inventor: Steven L. Kayser, Ferndale, WA (US)

(73) Assignee: Loops, LLC, Ferndale, WA (US)

( * ) Notice: Subject to any disclaimer, the term of this patent is extended or adjusted under 35 U.S.C. 154(b) by 1070 days.

(21) Appl. No.: 11/563,671

(22) Filed: Nov. 27, 2006

(65) Prior Publication Data

US 2007/0226931 A1 Oct. 4, 2007

Related U.S. Application Data

(63) Continuation-in-part of application No. 10/920,822, filed on Aug. 18, 2004, now Pat. No. 7,334,286.

(51) Int. Cl.
*A46B 9/04* (2006.01)
*A46B 5/02* (2006.01)

(52) U.S. Cl.
USPC ..... 15/167.1; 15/143.1; 15/144.1; 15/176.1; 15/176.5

(58) Field of Classification Search
USPC ..... 15/143.1, 167.1, 176.1, 176.4, 176.5, 15/176.6, 144.1
See application file for complete search history.

(56) References Cited

U.S. PATENT DOCUMENTS 1,645,965 A * 10/1927 Neumerkel ..... 15/227
1,717,125 A * 6/1929 Spitz ..... 15/176.4
1,875,476 A * 9/1932 McNally ..... 15/176.4
1,908,510 A * 5/1933 Dodson ..... 15/176.4
1,939,001 A * 12/1933 Doll ..... 15/176.1
1,945,559 A * 2/1934 McNally ..... 15/176.4
2,706,825 A * 4/1955 Blakeman ..... 15/176.4
2,719,626 A 10/1955 Lermer
2,775,250 A 12/1956 Oxenrider
2,815,057 A 12/1957 Tupper
2,835,912 A * 5/1958 Pensky ..... 15/143.1
D243,156 S 1/1977 Fentules
4,020,521 A * 5/1977 Velasquez ..... 15/172
4,234,087 A 11/1980 Pandak
4,615,635 A 10/1986 Kim
5,020,179 A * 6/1991 Scherer ..... 15/22.1
5,076,428 A 12/1991 Shaw
5,150,495 A * 9/1992 Discko et al. ..... 15/167.1
D337,207 S 7/1993 Tiramani et al.
D338,123 S 8/1993 Crawford (Continued)

FOREIGN PATENT DOCUMENTS

EP 336641 10/1989
JP 2003-265234 * 9/2003
WO 0129128 4/2001

*Primary Examiner* — Randall Chin
(74) *Attorney, Agent, or Firm* — Lewis Kohn & Fitzwilliam LLP; Timothy W. Fitzwilliam; Kari Moyer-Henry

(57) ABSTRACT

The disclosed embodiments relate to a toothbrush and methods of making it. The toothbrush may have an elongated body being composed of a first material and having a head portion and a handle portion, a head composed of a second material and disposed in the head portion of the elongated body, and a plurality of bristles extending from the head forming a bristle brush. The method of making a toothbrush may include molding a head of a first material, inserting the head into an elongated body mold, molding an elongated body having a head portion and a handle portion of a second material onto the head, and inserting bristles into the head. The first material is more rigid than the second material.

20 Claims, 3 Drawing Sheets

U.S. PATENT DOCUMENTS

| | | | | | |
|---|---|---|---|---|---|
| 5,291,878 | A | | 3/1994 | Lombardo et al. | |
| 5,375,711 | A | | 12/1994 | Bree et al. | |
| 5,604,952 | A | * | 2/1997 | Zeleznick | 15/167.1 |
| 5,622,195 | A | | 4/1997 | Lee | |
| 5,630,244 | A | | 5/1997 | Chang | |
| 5,630,505 | A | | 5/1997 | Garcia | |
| 5,651,158 | A | * | 7/1997 | Halm | 15/167.1 |
| 5,673,452 | A | * | 10/1997 | Chang et al. | 15/167.1 |
| 5,778,478 | A | | 7/1998 | Coleman | |
| 5,850,659 | A | * | 12/1998 | Butler et al. | 15/167.1 |
| 5,864,915 | A | * | 2/1999 | Ra | 15/167.1 |
| 6,276,020 | B1 | * | 8/2001 | Leversby et al. | 15/167.1 |
| 6,295,686 | B1 | | 10/2001 | Phillips | |
| 6,298,516 | B1 | * | 10/2001 | Beals et al. | 15/143.1 |
| 6,408,473 | B1 | * | 6/2002 | Kessler | 15/104.94 |
| 6,546,583 | B1 | | 4/2003 | Rohrig | |
| 6,668,416 | B1 | | 12/2003 | Georgi et al. | |
| 6,895,624 | B2 | * | 5/2005 | Fischer et al. | 15/22.1 |
| 6,996,870 | B2 | * | 2/2006 | Hohlbein | 15/110 |
| 7,418,759 | B2 | * | 9/2008 | Huber et al. | 15/167.1 |
| 2003/0208870 | A1 | | 11/2003 | Jimenez | |

* cited by examiner

TOOTHBRUSH AND METHODS OF MAKING AND USING SAME

CROSS-REFERENCE TO RELATED APPLICATION

This application is a continuation-in-part of prior patent application Ser. No. 10/920,822, filed Aug. 18, 2004, now U.S. Pat. No. 7,334,286.

FIELD OF THE INVENTION

The present invention relates in general to a toothbrush and methods of making and using it. It more particularly relates to such a toothbrush, which is compact in size and may be safely used by prison or other inmates, and a method of making same.

BACKGROUND ART

There is no admission that the background art described in this section legally constitutes prior art.

Prison and other detention systems monitor devices permitted to be used by inmates to prevent the use of otherwise safe device as a weapon. For example, conventional toothbrushes are not permitted to be used by many prison systems because they may be fashioned into a pointed shaft or rod or otherwise used as a shank for a sharp object such as a razor blade, which could be used to endanger other inmates or themselves, as well as security personnel.

In an attempt to provide a safe alternative toothbrush for use by inmates for dental hygiene purposes, a toothbrush is currently being used which includes a brush head and a very short handle. The handle is so short that it must be grasped by only the thumb and forefinger of the user. However, such a toothbrush is awkward to use. The fingers of the user may be required to enter the mouth to reach all of the teeth. Such a difficult to use toothbrush may result in inadequate teeth cleaning, and be awkward and uncomfortable to use. Such ineffectual cleaning procedures may cause, or at the least contribute to, poor dental hygiene, thereby leading to costly dental procedures in some instances.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DETAILED DESCRIPTION OF CERTAIN EMBODIMENTS OF THE INVENTION

Figure 1:
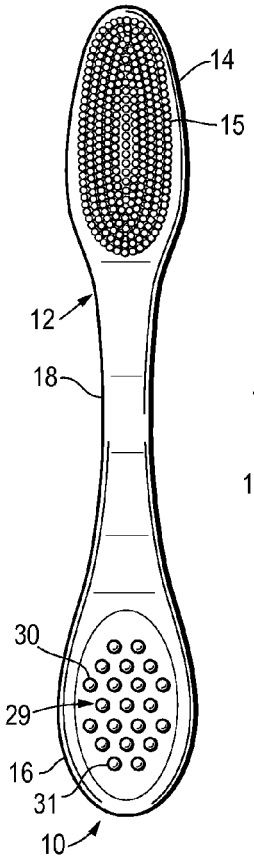
FIG. 1 is a plan view of the underside of a toothbrush, which is constructed according to an embodiment of the invention.
Figure 2:
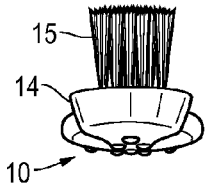
FIG. 2 is a front end view of the toothbrush of FIG. 1.
Figure 3:
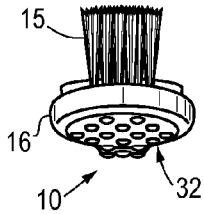
FIG. 3 is a rear end view of the toothbrush of FIG. 1.

Certain embodiments of the present invention will now be described more fully hereinafter with reference to the accompanying drawings, in which some, but not all, embodiments of the invention are shown. Indeed, these embodiments of the invention may be in many different forms and thus the invention should not be construed as limited to the embodiments set forth herein; rather, these embodiments are provided as illustrative examples only so that this disclosure will satisfy applicable legal requirements. Like numbers refer to like elements throughout.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiment of the invention.

The disclosed embodiments relate to a toothbrush and methods of making and using it, wherein an elongated body has a bristle brush head portion and a handle portion. The body is composed of flexible material so that the handle portion can be grasped in the hand of the user, and the user can flex the elongated body into a substantially rigid position for teeth brushing purposes.

According to other embodiments, the length of the body is up to about 4.5 inches.

According to still other embodiments of the invention, the material of the body may be composed of an extrudable elastomer selected from the group consisting of silicone, neoprene, EPDM, nitrile, fluoroelastomers, natural rubber, styrene-butadiene rubber, thermoplastic elastomers, polyvinyl alcohol, PMMA, polyamide, polyester terephthalate, polycarbonate, polyetherimide, polyethylene (LDPE, HDPE, LLDPE, and blends), polypropylene and copolymers, polysulfone, polyvinyl chloride, viton, PUNA nitrile, carboxylated nitrile, polysulfides, alpha olefin elastomers, conjugated diene elastomers, hydrogenated diene elastomers, ethylene carboxylate, ethylene-propylene-diene elastomers, functionalized ethylene-vinyl acetate, SB-diblock copolymers, SBS and SIBS-triblock copolymers, and acrylic rubber.

According to further embodiments of the invention, there is provided a method of using a toothbrush by grasping a handle portion in the hand of the user, and pressing on a portion of the elongated body of the toothbrush with a digit of the user to flex the elongated body into a substantially rigid flexed position. The teeth may then be brushed for cleaning purposes. According to the disclosed embodiments, the pressing on the body may include moving the digit of the user into contact with a digit engageable portion of the body, and the flexed position may include the brush head portion of the toothbrush disposed at an angle of about 45 degrees relative to the handle portion.

According to still further embodiments of the invention, there is provided a method of making a toothbrush by molding a head of a first material, inserting the head into an elongated body mold, molding an elongated body having a head portion and a handle portion of a second material onto the head, and inserting bristles into the head. According to the disclosed embodiments, the first material is more rigid than the second material.

According to yet further embodiments of the invention, there is provided another method of making a toothbrush by molding a head having at least two index pins, inserting the head into an elongated body mold, aligning the head within the elongated body mold using the index pins, molding an elongated body having a head portion and a handle portion onto the head, and inserting bristles into the head.

According to other embodiments of the invention, there is provided a toothbrush having an elongated body being composed of a first material and having a head portion and a handle portion, a head composed of a second material and disposed in the head portion of the elongated body, and a plurality of bristles extending from the head forming a bristle brush. According to the disclosed embodiments, the first material is more rigid than the second material.

Referring now to the drawings, and more particularly to FIGS. 1, 2, 3, 4, and 5 thereof, there is shown a toothbrush 10, which may be constructed in accordance with an embodiment of the invention. The toothbrush 10 includes an elongated body 12 having a bristle brush head portion 14 having a bristle brush 15 extending therefrom. The elongated body 12 includes a handle portion 16 and a narrowed intermediate portion 18 integrally connecting the head portion 14 and the handle portion 16.

A digit engageable irregular surface 20 on the upper surface of the intermediate portion 18 is adapted to be engaged by a digit of the user to help flex it into a substantially rigid position for brushing the teeth. The digit engageable irregular surface 20 includes a rigid surface 21 formed of projections or ridges such as the ridges 23 and 25 to facilitate grasping the body 12 with a digit of the user. While it is shown and described that the thumb of the user may engage the surface 20, it is contemplated that a finger such as an index finger may also be preferredly used to press on the surface 20, instead of the thumb.

Figure 4:
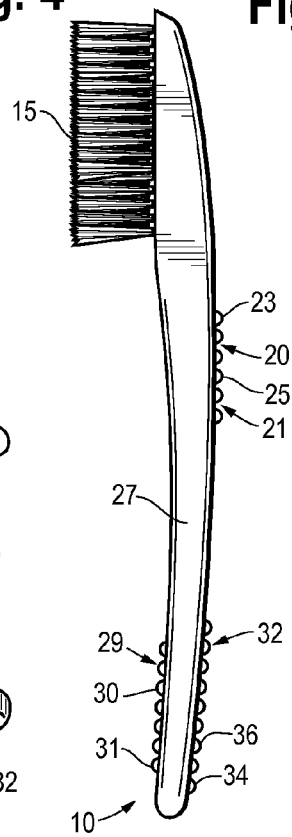
FIG. 4 is a side end view of the toothbrush of FIG. 1.
Figure 5:
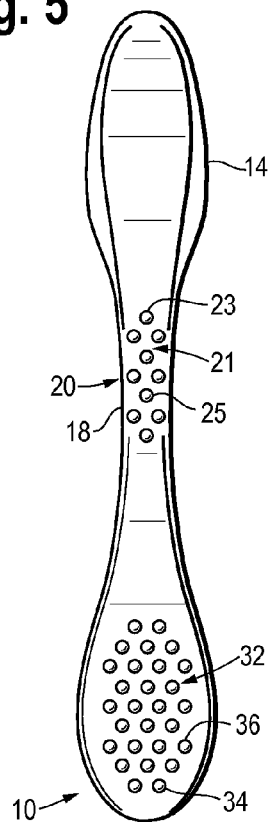
FIG. 5 is a plan view of the top side of the toothbrush of FIG. 1.

As best seen in FIG. 4, the body 12 has a slightly curved side edge or curved aspect 27 between the head portion 14 and the handle portion 16, to help facilitate the flexing of the body 12 by the hand of the user. An irregular surface 29 on the underside of the handle portion 16 includes a group of projections or ridges such as ridges 30 and 31. Similarly, an irregular surface 32 on the top side of the handle portion 16 includes projections or ridges such as ridges 34 and 36. Thus, the irregular surfaces on the handle portion 16 facilitate the grasping of the handle portion when the hands are wet to help grasp the toothbrush 10 during use.

Figure 6:
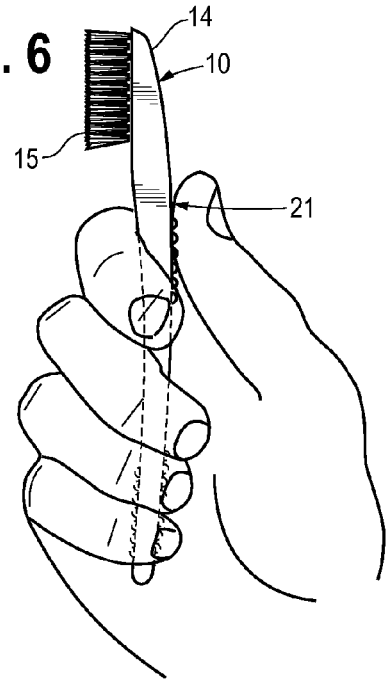
FIGS. 6 and 7 are reduced scale views similar to FIG. 4, illustrating it in the process of being used.
Figure 7:
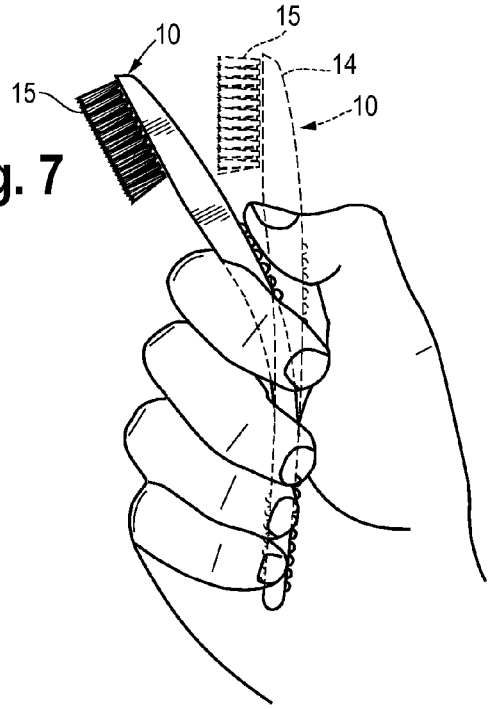
Figure 8:
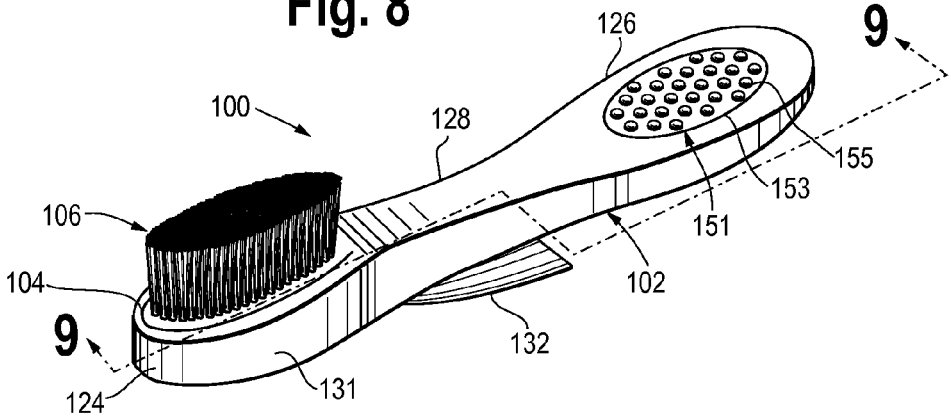
FIG. 8 is a pictorial view of a toothbrush which is constructed according to another embodiment of the invention.

According to an embodiment of the invention, as shown in FIGS. 6 and 7, there is shown the placement of the combined thumb and index finger, or other convenient manner of holding the toothbrush 10 in the hand of the user to perform a tooth brushing operation. The top half or head portion 14 of the toothbrush 10 is positioned by flexing the body 12 to cause the head portion 14 to assume a position in about a 45 degree angle relative to the handle portion 16 to facilitate the cleaning process. The use of the toothbrush 10 may require the combined use of an index finger and a thumb of the same hand. The head portion 14 and remaining portion, such as the intermediate portion 18, may be flexible or otherwise deformable or breakable or other, to prevent or limit the possibility of using or converting the toothbrush 10 to a shank/stabbing weapon device in an environment requiring safety such as prisons—and also to contribute to less abrasion and trauma to the teeth and gums while brushing.

In use, the digit such as the thumb, index finger or other may act as a guide to place the brush head portion 14 in an approximate 45 degree angle relative to the handle portion 16, to steady the head portion 14 and the handle portion 16, to help direct the head portion 14 into the mouth and place the head portion 14 into engagement with the teeth, and to steady the flexible intermediate portion 18 and head portion 14, while using the brush 15 in the act of brushing the teeth.

The placement of the digit such as the thumb, index finger or other on or near the ridges of the irregular surface 20 helps to alleviate slippage if the body 12 becomes wet. The ridges such as ridge 23 and 25 may be increased or decreased in number and arrangement or the irregular area expanded in area or length.

For the purposes of safety (i.e. prison market) the length of the body 12 of the toothbrush 10 should be up to approximately 4½ inches in length. More preferably, the length of the body 12 is between about 3.0 inches and 4.5 inches. Still more preferably, the length of the body 12 is between about 3.5 inches and about 4.5 inches. The most preferred length of the body 12 is about 4.5 inches.

The head portion 14 may have a slightly wider head portion 14 as shown in FIG. 1. Also, the intermediate portion 18 may vary in width, and may be wider than the portion 18 shown in FIG. 1. Additionally, the hardness of the material of the body 12 may vary, depending on the degree of safety desired and the selection of the material. A harder material may affect the need for more pressure exertion by the digit of the user. The preferred hardness is a durometer hardness of between about 75 and about 95 on the Shore A scale.

Referring now to FIGS. 8, 9, 10, 11 and 12 thereof, there is shown a toothbrush 100, which may be constructed in accordance with another embodiment of the invention. The toothbrush 100 may include an elongated body 102 and a head 104 having a bristle brush 106 extending therefrom. The elongated body 102 may be made of a flexible material as described previously. The head 104 may be made of a more rigid material to facilitate attachment of the bristle brush 106.

The head 104 may include a body 108 having a top side 111 and a bottom side 113. The top side 111 of the head 104 may contain a plurality of holes 115 for the insertion of a plurality of bristle groups 117 containing a plurality of bristles to form the bristle brush 106. The bottom side 113 of the head 104 may include a pair of index pins 119 and 122. The index pins 119 and 122 may be integrally connected to the head 104 and may extend away from the bottom side 113 of the head 104. The head 104 may be no greater in size than necessary to hold the bristle brush 106 to prevent fashioning or using the head 104 as a weapon. The material of the head 104 may be composed of an extrudable and/or injectable plastic.

The elongated body 102 may include a head portion 124, a handle portion 126, and a narrowed intermediate portion 128 integrally connecting the head portion 124 and the handle portion 126. The head portion 124 of the elongated body 102 may include a side wall 131 and a back wall 133 substantially defining a cavity 135 in the head portion 124 in which the head 104 may be disposed. The back wall 133 of the head portion 124 may include a pair of passageways 137 and 139 for index pins 119 and 122, respectively. The head portion 124 may significantly surround the head 104 to further prevent fashioning or using the head 104 as a weapon.

A digit engageable irregular surface 142 on the upper surface of the intermediate portion 128 may be adapted to be engaged by a digit of the user to help flex it into a substantially rigid position for brushing the teeth. The digit engageable irregular surface 142 may be formed of projections or ridges such as the projections 144 and 146 to facilitate grasping the body 102 with a digit of the user.

Figure 12:
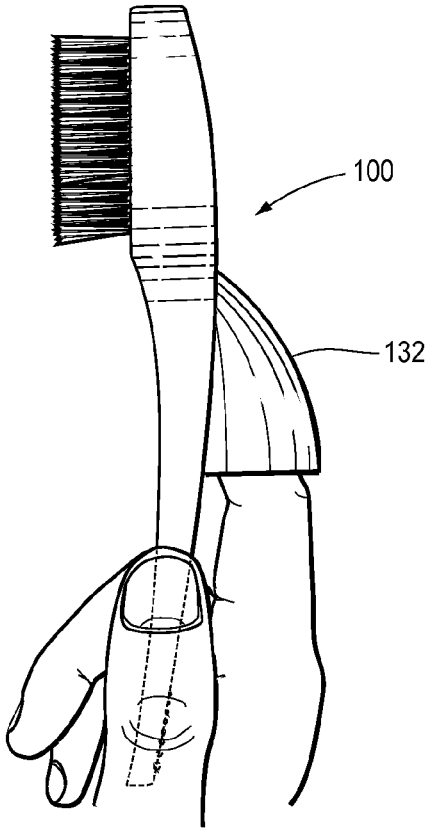
FIG. 12 is a side view similar to FIG. 9, illustrating it in the process of being used.

A pocket 132 or other suitable device may be included on the handle portion 126 of the elongated body 102 enclosing the irregular surface 142. The pocket 132 may guide and/or keep an index or other finger of the user in place to support the toothbrush during brushing as shown in FIG. 12 prior to flexing the toothbrush. By applying a force with the index finger, the toothbrush may be bent as shown in FIG. 7. The pocket 132 may be made of the same or similar material as the elongated body 102 to facilitate keeping the finger in place to flex the handle portion 126 and/or to guide the head portion 124 for brushing. The pocket 132 may be molded to the handle portion 126 or attached to the handle portion 126 by another suitable means.

Figure 9:
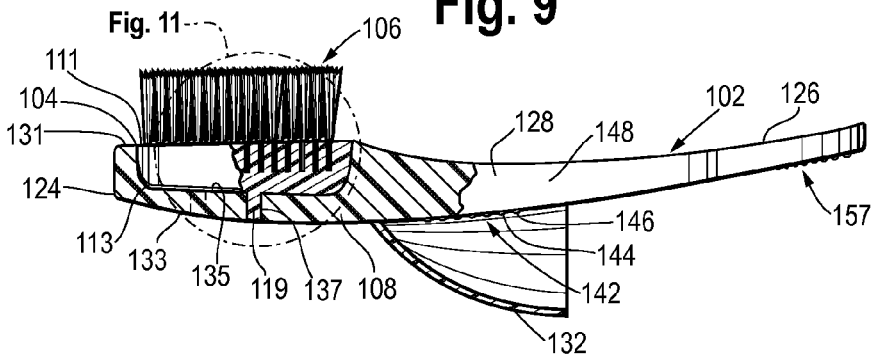
FIG. 9. is a side partial sectional view of the toothbrush of FIG. 8 taken substantially on through line 9-9 thereof.

As best seen in FIG. 9, the body 102 may have a slightly curved side edge or curved aspect 148 between the head portion 124 and the handle portion 126, to help facilitate the flexing of the body 102 by the hand of the user. An irregular surface 151 on the underside of the handle portion 126 may include a group of projections or ridges such as projections 153 and 155. Similarly, an irregular surface 157 (FIG. 10) on the top side of the handle portion 126 may include projections or ridges such as projections 159 and 162. Thus, the irregular surfaces on the handle portion 126 may facilitate the grasping of the handle portion when the hands are wet to help grasp the toothbrush 100 during use and may also be utilized as a tongue scrubber.

The projections on any of the irregular surfaces, such as projections 144 and 146 on irregular surface 142, may be increased or decreased in number and arrangement or the area of the irregular surface may be expanded in area or length.

The portions of the elongated body 102, such as the intermediate portion 128, may be flexible or otherwise deformable or breakable or other, to prevent or limit the possibility of using or converting the toothbrush 100 to a shank/stabbing weapon device in an environment requiring safety such as prisons—and also to contribute to less abrasion and trauma to the teeth and gums while brushing.

For the purposes of safety (i.e. prison market) the length of the body 102 of the toothbrush 100 should be up to approximately 4½ inches in length. More preferably, the length of the body 102 is between about 3.0 inches and 4.5 inches. Still more preferably, the length of the body 102 is between about 3.5 inches and about 4.5 inches. The most preferred length of the body 102 is about 4.5 inches.

Figure 10:
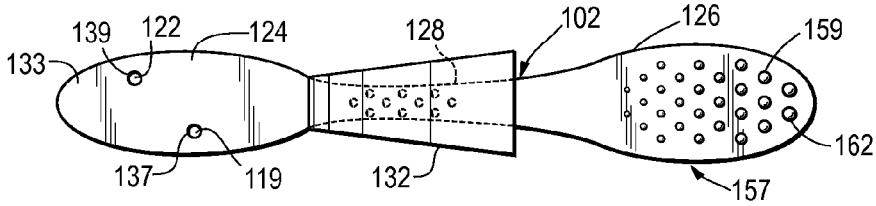
FIG. 10 is a top plan view of the toothbrush of FIG. 8.
Figure 11:
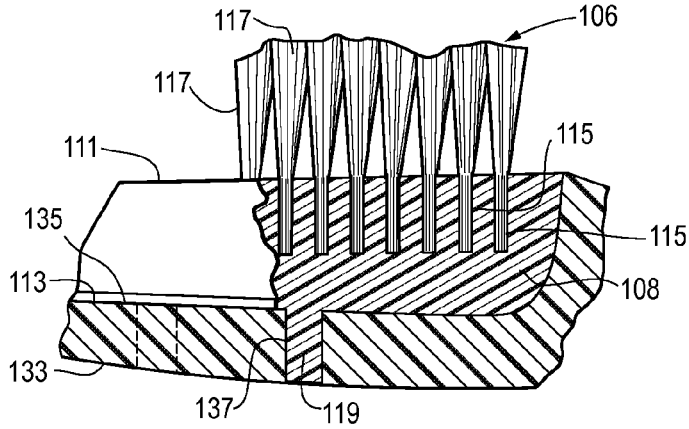
FIG. 11 is an enlarged view of the circled portion of the toothbrush of FIG. 9.

The head portion 124 may vary in width, and may be a slightly wider than the head portion 124 as shown in FIG. 10. Also, the intermediate portion 128 may vary in width, and may be wider than the portion 128 shown in FIG. 10. Additionally, the hardness of the material of the body 102 may vary, depending on the degree of safety desired and the selection of the material. A harder material may affect the need for more pressure exertion by the digit of the user. The preferred hardness of the material of the body 102 is a durometer hardness of between about 75 and about 95 on the Shore A scale.

The toothbrush 100 may be used in the same manner and way as described above regarding the toothbrush 10.

Figure 13:
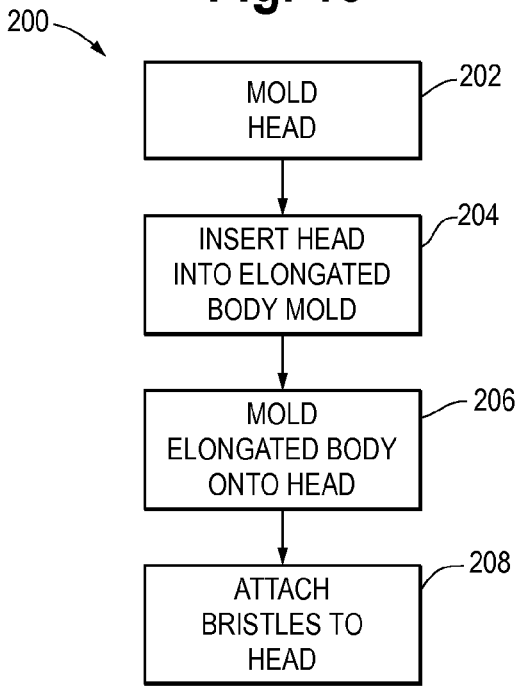
FIG. 13 is a flow chart diagram of a method of making the toothbrush of FIG. 8.

Referring now to FIG. 13, a method of making the toothbrush 100 is shown and generally referenced as 200. The first step 202 of method 200 may be to mold the head 104. The head 104 may be molded of a rigid material to include a body 108 having a plurality of holes 115 on the top side 111 and index pins 119 and 121 extending from the bottom side 113. The head 104 may be no greater in size than necessary to hold the bristle brush 106 to prevent fashioning or using the head 104 as a weapon.

The head 104 may be inserted into the elongated body mold in the next step 204 using the index pins 119 and 121 to facilitate alignment of the head 104 within the mold. The index pins 119 and 121 may act as guides to keep the head 104 in place to substantially reduce waste and rejection of the molded toothbrushes.

In step 206, the elongated body 102 may be molded onto the head 104 using a flexible material. The head portion 124 of the elongated body may encase all but the top side 111 of the head 104 with the index pins 119 and 121 extending to the exterior surface of the back wall 133 of the head portion to further prevent fashioning or using the head 104 as a weapon. A pocket 132 may also be molded to the elongated body 102 for insertion of a finger by the user to facilitate use of the toothbrush. Lastly, a plurality of bristle groups 117 may be inserted into the holes 115 of the head to create the bristle brush 106 in step 208.

It should be understood that these toothbrushes may be used for a variety of purposes. It may be used for cleaning the teeth of animals such as pets. These toothbrushes may be used in travel kits due to its compact size. For such applications, a harder material may be used, and result in less reliance on the digit pressing on the digit engageable irregular surface to guide the head portion and the length of the bristle brush may vary. For example, a longer handle portion and less flexible material may be employed for a larger pet.

The more flexible the materials, the less safety risk (for the prison environment). The hardness of the material directly affects the flexibility. Different hardness of the material or different materials used, may tailor these toothbrushes to meet a range of safety concerns needed from maximum security prisons (the highest) down to minimum security prisons.

The bristles may be the same type or quality as are found in conventional toothbrushes, and may be soft, medium or firm. Oval shaped bristles may be employed, but other shapes such as square may be employed as well.

These toothbrushes when used in correctional facilities may lessen the risk to inmates and correctional officers from an inmate using the toothbrush or modifying it as a slashing weapon device. Inmates can fashion such a weapon from a conventional hard plastic toothbrush by cutting a notch in the head or bottom of the handle to insert a razor blade, and either melt the material around the razor blade (or glass or similar sharp material) to hold the sharp object in place. After the melted area cools, such a device becomes a dangerous weapon for the use described. The embodiment of the invention may substantially lessen or eliminate the fashioning of such a device, because the material may not have the strength and rigidity of a conventional stiff handled toothbrush.

These toothbrushes may be constructed of a clear material, in part or all. The correctional market desires products that are either constructed of clear material to lessen the possibility of contraband being hidden. For the retail or pet markets, solid colored material may be employed.

Many conventional toothbrushes are designed with a lengthy handle, usually with some ergonomic design, but usually with an overall design to condition the user to grasp the handle with the entire hand and bring the entire stiff handled device to bear force and pressure on the teeth and gums. Such operation may cause pain and excessive wear and abrasion to teeth and gums.

The disclosed embodiment invention eliminates or lessens much of those negative characteristics. The user of the flexible handled toothbrush can use much less force and pressure on teeth and gums with a small amount of pressure using the digit such as the thumb or index finger, to guide the head portion. Such construction tends to eliminate the use of the entire hand to manipulate a long, stiff conventional handle that is designed to be used with the entire hand and requiring ergonomic design to lessen the negative features of having to grasp with the entire hand a handle and twisting the wrist. A conventional long handled toothbrush requires twisting or manipulation of the hand and wrist. Whereas, these toothbrushes use more manipulation of the digits and less wrist action to place the flexible head portion onto the teeth to be cleaned.

The elongated body may have added ridges positioned further up the inside of the handle, about an inch from the thumb area to prevent possible slippage in case the user places their thumb outside the intended area.

The different materials to construct the handle will also have some features to lessen slippage when the device is wet. Conventional toothbrushes use similar materials, such as the tactile feel of rubber.

There are areas left for product identification on the underside of the toothbrush as well as the top area of the head, for incorporating into the mold or tooling for molding indicia (not shown) thereon.

Although these toothbrushes are currently preferred to accommodate the prison environment, the pet market could use a larger size body to provide a longer handle. A possible application could also include the retail market and the travel kit market (space requirements for travel kits necessitates downsized articles—i.e., a short handle toothbrush) or a device with a handle extension.

The head portion may be a separate part and molded to the shaft during the manufacturing process. The bristles (number of cavities, and tufts or strands per cavity) should be similar to any conventional toothbrush. The head portion may vary in size, and may be sized to the mouth of an average user. Also, there may be different angles for the bristles. The bristles may be inserted after the material of the body partially or completely cools.

There may be different methods being used to insert the bristles. It should be noted that only a portion of the body may be flexible or otherwise deformable.

A variety of material hardness of the body may be employed to adjust the flexibility thereof to adjust the softness portion to limit twisting thereof relative to the handle portion.

Although the invention has been described with reference to the above examples, it will be understood that many modifications and variations are contemplated within the true spirit and scope of the embodiments of the invention as disclosed herein. Many modifications and other embodiments of the invention set forth herein will come to mind to one skilled in the art to which the invention pertains having the benefit of the teachings presented in the foregoing descriptions and the associated drawings. Therefore, it is to be understood that the invention shall not be limited to the specific embodiments disclosed and that modifications and other embodiments are intended and contemplated to be included within the scope of the appended claims. Although specific terms are employed herein, they are used in a generic and descriptive sense only and not for purposes of limitation.

What is claimed is:

1. A toothbrush, comprising:

an elongated body being flexible throughout the elongated body and comprising a first material and having a head portion and a handle portion;

a head comprising a second material, wherein the head is disposed in and molded to the head portion of the elongated body; and a plurality of bristles extending from the head forming a bristle brush, wherein the first material is less rigid than the second material.

2. The toothbrush of claim 1, wherein the head includes at least two index pins parallel to the plurality of bristles.

3. The toothbrush of claim 1, wherein the head includes a plurality of holes for insertion of the bristles, wherein the bristles are inserted in a bristle group into the holes of the head.

4. The toothbrush of claim 1, wherein the second material is durable and has a durometer hardness of between about 75 and about 95 on the Shore A scale.

5. The toothbrush of claim 1, wherein the second material is one selected from the group consisting of polyurethane, silicone, neoprene, EPDM, nitrile, fluoroelastomers, natural rubber, styrene-butadiene rubber, thermoplastic elastomers, polyvinyl alcohol, PMMA, polyamide, polyester terephthalate, polycarbonate, polyetherimide, polyethylene (LDPE, HDPE, LLDPE, and blends), polypropylene and copolymers, polysulfone, polyvinyl chloride, viton, PUNA nitrile, carboxylated nitrile, polysulfides, alpha olefin elastomers, conjugated diene elastomers, hydrogenated diene elastomers, ethylene carboxylate, ethylene-propylene-diene elastomers, functionalized ethylene-vinyl acetate, SB-diblock copolymers, SBS and SIBS-triblock copolymers, and acrylic rubber.

6. The toothbrush of claim 1, wherein the length of the elongated body is between about 3.0 inches and about 4.5 inches.

7. The toothbrush of claim 1, wherein the handle portion is wider than the head portion and has a narrowed intermediate portion therebetween;

wherein the handle portion has a bulbous end in a top aspect, and wherein the bulbous end comprises a group of protrusions to facilitate grasping by a user.

8. The toothbrush of claim 7, wherein the intermediate portion includes a finger engageable irregular surface comprising a plurality of protrusions.

9. The toothbrush of claim 1, wherein the elongated body has a curved edge extending between the head portion and the handle portion.

10. The toothbrush of claim 1, further including a pocket attached to the head portion of the elongated handle for securing a user's finger to the toothbrush.

11. A toothbrush, comprising:

an elongated body being flexible throughout the elongated body comprising a first material and having a head portion and a handle portion;

a head comprising a second material, wherein the head is disposed in and molded to the head portion of the elongated body;

a plurality of bristles extending from the head forming a bristle brush, the head further comprising two index pins, wherein the first material substantially encases the second material at the head portion.

12. The toothbrush of claim 11, wherein the head includes a plurality of holes for insertion of the bristles, wherein the bristles are inserted in a bristle group into the holes of the head.

13. The toothbrush of claim 11, wherein the second material is durable and has a durometer hardness of between about 75 and about 95 on the Shore A scale.

14. The toothbrush of claim 11, wherein the second material is one selected from the group consisting of polyurethane, silicone, neoprene, EPDM, nitrile, fluoroelastomers, natural rubber, styrene-butadiene rubber, thermoplastic elastomers, polyvinyl alcohol, PMMA, polyamide, polyester terephthalate, polycarbonate, polyetherimide, polyethylene (LDPE, HDPE, LLDPE, and blends), polypropylene and copolymers, polysulfone, polyvinyl chloride, viton, PUNA nitrile, carboxylated nitrile, polysulfides, alpha olefin elastomers, conjugated diene elastomers, hydrogenated diene elastomers, ethylene carboxylate, ethylene-propylene-diene elastomers, functionalized ethylene-vinyl acetate, SB-diblock copolymers, SBS and SIBS-triblock copolymers, and acrylic rubber.

15. The toothbrush of claim 11, wherein the length of the elongated body is between about 3.0 inches and about 4.5 inches.

16. The toothbrush of claim 11, wherein the elongated body has a curved edge extending between the head portion and the handle portion.

17. The toothbrush of claim 11, further including a pocket attached to the head portion of the elongated handle for securing a user's finger to the toothbrush.

18. A toothbrush, comprising:

an elongated body comprising a first material and having a head portion and a handle portion;

a head comprising a second material and disposed in and molded to the head portion of the elongated body, wherein the handle portion is wider than the head portion and has a narrowed intermediate portion therebetween, and further wherein the first material is different from the second material such that the second material comprising the head is more rigid than the first material comprising the elongated body; and wherein the handle portion has a bulbous end in a top aspect and is generally a tapered rectangle in a side aspect, the bulbous end together with the head providing generally a barbell shape in the top aspect.

19. The toothbrush of claim 18, wherein the intermediate portion includes a finger engageable irregular surface comprising a plurality of protrusions.

20. The toothbrush of claim 18, further including a pocket attached to the head portion of the elongated handle for securing a user's finger to the toothbrush.

* * * * *